US007354774B2

(12) United States Patent
Hughes et al.

(10) Patent No.: US 7,354,774 B2
(45) Date of Patent: Apr. 8, 2008

(54) SELF ALIQUOTING SAMPLE STORAGE PLATE

(75) Inventors: Kevin Hughes, Burlington, MA (US); Mark Perreault, Leominster, MA (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 602 days.

(21) Appl. No.: 10/435,856

(22) Filed: May 12, 2003

(65) Prior Publication Data

US 2004/0033168 A1 Feb. 19, 2004

Related U.S. Application Data

(60) Provisional application No. 60/379,397, filed on May 13, 2002.

(51) Int. Cl.
*G01N 1/10* (2006.01)
*B01L 3/02* (2006.01)

(52) U.S. Cl. ..... 436/180; 422/100

(58) Field of Classification Search ..... 422/100, 422/102, 104; 436/180
See application file for complete search history.

(56) References Cited

U.S. PATENT DOCUMENTS 3,572,552 A * 3/1971 Guinn ..... 222/263
3,999,689 A 12/1976 Ciantro et al.
4,195,524 A 4/1980 Hansen
4,483,925 A 11/1984 Noack
4,496,657 A 1/1985 Coppersmith et al.
4,810,471 A 3/1989 Wachob et al.
5,147,606 A * 9/1992 Charlton et al. ..... 422/56
5,259,447 A 11/1993 Ogushi et al.
5,262,128 A 11/1993 Leighton et al.
5,472,672 A 12/1995 Brennan
5,700,695 A 12/1997 Yassinzadeh et al.
5,817,510 A 10/1998 Pandey et al.
5,965,410 A 10/1999 Chow et al.
6,048,734 A 4/2000 Burns et al.
6,103,199 A 8/2000 Bjornson et al.
6,111,652 A 8/2000 Melendez et al.
6,117,396 A * 9/2000 Demers ..... 422/100
6,130,098 A 10/2000 Handique et al.
6,136,273 A * 10/2000 Seguin et al. ..... 422/99
6,218,193 B1 4/2001 Kraft et al.
6,248,113 B1 6/2001 Fina
6,296,811 B1 10/2001 Sasaki (Continued)

FOREIGN PATENT DOCUMENTS

EP 0 496 200 A2 7/1992

(Continued)

*Primary Examiner*—Brian R. Gordon
(74) *Attorney, Agent, or Firm*—Nanette S. Thomas

(57) ABSTRACT

A self-aliquoting dispensing unit for use with a multi-receptacle storage unit is provided including a lower plate having a plurality of access ports therethrough, wherein at least one of the access ports is in fluid communication with a microtube, an upper plate releasably attached to the lower plate, the upper plate including a sample port for supplying a sample to the dispensing unit, and a sealing member for forming a reversible fluid tight connection between the storage unit and the upper plate. An assembly for dispensing a sample into a multi-receptacle storage unit and a method for dispensing a sample into a multi-receptacle storage unit are also provided.

16 Claims, 9 Drawing Sheets

U.S. PATENT DOCUMENTS 6,302,159 B1 10/2001 Ryan et al.
6,326,212 B1 * 12/2001 Aoki ..... 436/180
6,350,617 B1 2/2002 Hindsgaul et al.
6,365,418 B1 4/2002 Wagner et al.
6,376,256 B1 * 4/2002 Dunnington et al. ..... 436/178
6,383,453 B1 5/2002 Banauch et al.
6,436,351 B1 * 8/2002 Gubernator et al. ..... 422/102
6,455,005 B1 * 9/2002 Berray et al. ..... 422/99
6,485,690 B1 * 11/2002 Pfost et al. ..... 422/102
6,488,895 B1 * 12/2002 Kennedy ..... 422/100
6,780,381 B2 * 8/2004 Yiu ..... 422/100
6,793,891 B2 * 9/2004 Yiu ..... 422/100
6,805,840 B1 * 10/2004 Tajima ..... 422/100
6,815,198 B2 * 11/2004 Nemoto et al. ..... 435/287.2
6,833,112 B2 * 12/2004 Hoummady ..... 422/61
6,846,456 B2 * 1/2005 Acosta et al. ..... 422/65
6,852,289 B2 * 2/2005 Gordon et al. ..... 422/101
6,951,632 B2 * 10/2005 Unger et al. ..... 422/100
7,025,935 B2 * 4/2006 Jones et al. ..... 422/100
7,081,600 B2 * 7/2006 Brown et al. ..... 219/428
2001/0049148 A1 * 12/2001 Wolk et al. ..... 436/180
2002/0076353 A1 * 6/2002 Lehmann ..... 422/68.1
2002/0084185 A1 * 7/2002 Sundberg et al. ..... 204/453
2003/0064504 A1 * 4/2003 Rothmann et al. ..... 435/287.1
2004/0037750 A1 * 2/2004 Stimpson et al. ..... 422/100
2004/0047765 A1 * 3/2004 Gordon et al. ..... 422/63
2004/0071602 A1 * 4/2004 Yiu ..... 422/100
2004/0109793 A1 * 6/2004 McNeely et al. ..... 422/100
2004/0126279 A1 * 7/2004 Renzi et al. ..... 422/100
2004/0208794 A1 * 10/2004 Karg et al. ..... 422/100
2005/0112776 A1 * 5/2005 Clark et al. ..... 436/180
2005/0118067 A1 * 6/2005 Noolandi ..... 422/100
2006/0078470 A1 * 4/2006 Zhou et al. ..... 422/100

FOREIGN PATENT DOCUMENTS

WO WO 02/072423 A1 9/2002

* cited by examiner

SELF ALIQUOTING SAMPLE STORAGE PLATE

This application claims the benefit of U.S. Provisional Patent Application No. 60/379,397, filed on May 13, 2002.

BACKGROUND OF THE INVENTION

1. Field of the Invention

The present invention relates to a device and method for chemical processing of a biological sample, and more particularly to a self-aliquoting sample dispensing assembly. The dispensing assembly, which comprises a dispensing unit and a storage unit, has a plurality of receptacles and is capable of dispensing a sample substantially simultaneously into each of the plurality of receptacles. The dispensing assembly is well suited for dispensing samples for subsequent high throughput screening, and is particularly useful for dispensing, storing and transporting biological samples for subsequent clinical analysis.

2. Description of Relevant Art

Presently, across a broad range of technology-based business sectors, including the chemical, bioscience, biomedical, and pharmaceutical industries, it has become increasingly desirable to develop capabilities for rapidly and reliably carrying out chemical and biochemical reactions in large numbers using small quantities of samples and reagents. Carrying out a massive screening program manually, for example, can be exceedingly time-consuming, and may be entirely impracticable where only a very small quantity of a key sample or component of the analysis is available, or where a component is very costly.

In order to perform this function effectively, systems and methods have been developed for accurate and rapid dispensing of liquid samples and/or reagents, for example into multi-well plates. Typical multi-well plates contain 96, 192, 384, or 1536 receptacles which must be filled with a predetermined amount of a liquid sample.

Conventional pipettes are known which can accurately dispense a known quantity of liquid sample into a receptacle or other container. Manual pipettes have the obvious limitation of requiring sequential operation which is time consuming and inefficient. More automated devices, such as multi-channel pipetters are commercially available and represent an improvement over manually operated pipettes. In one example, a 96 channel pipetting device using positive displacement plungers in corresponding cylinders to draw in and expel liquid via a sampling/mltering step is known. Devices of this type are often complicated mechanisms and can be prone to problems in regulating the amount of liquid dispensed, controlling splashing, maintaining sterility, and the like.

In clinical diagnostic settings, it has often been necessary to collect biological samples such as whole blood, red blood cell concentrates, platelet concentrates, leukocyte concentrates, bone marrow apirates, plasma, serum, cerebral spinal fluid, feces, urine, cultured cells, saliva, oral secretions, nasal secretions and the like in various containers or tubes for subsequent testing and analysis. Typically, the samples must then be transported to a different location, such as a laboratory, where personnel conduct specific tests on the samples. Specific tests include experiments such as, for example, protein quantification, 2-D gel plotting of proteins, drug development, Western blotting, reporter gene analysis, immunoprecipitations, epitope tagging, specific protein activity assays, etc.

It is very desirable to rapidly detect and quantify one or more molecular structures in a sample. The molecular structures typically comprise ligands, such as antigens and antibodies. Ligands are molecules that are recognized by a particular receptor. Ligands may include, without limitation, agonists and antagonists for cell membrane receptors, toxins, venoms, oligosaccharides, proteins, bacteria and monoclonal antibodies. For example, cell and antibody detection is important in numerous disease diagnostics. In recent years there has been an increase in interest in the field of biological, medical and pharmacological science in the study of nucleic acids obtained from biological samples. For example, DNA or RNA sequence analysis is very useful in genetic and infectious disease diagnosis, toxicology testing, genetic research, agriculture and pharmaceutical development. In particular, genomic DNA (gDNA) isolated from human whole blood can provide extensive information on the genetic origin and function of cells. This information may be used in clinical practice, e.g., in predisposition testing, HLA typing, identity testing, analysis of hereditary diseases and oncology. The gDNA is analyzed via many molecular diagnostic downstream procedures (e.g., microarray analysis, quantitative PCR, real time PCR, Southern Blot analysis, etc).

In particular, nucleic acid-based analyses often require sequence identification and/or analysis such as in vitro diagnostic assays, high throughput screening of natural products for biological activity, and rapid screening of perishable items such as donated blood or tissues, for a wide array of pathogens. There has been a convergence of progress in chemistry and biology. Among the important advances resulting from this convergence is the development of methods for identifying molecular diversity and for detecting and quantifying biological or chemical material. This advance has been facilitated by fundamental developments in chemistry, including the development of highly sensitive analytical methods, solid-state chemical synthesis, and sensitive and specific biological assay systems. For example, Sanger Sequencing, blotting techniques, microplate assays, polymerase chain reaction, hybridization reactions, immunoassays, combinatorial libraries, proteomics and the like.

Traditional medical lab tests for biological samples require that the sample be obtained, transferred to a collection tube and then sent to a lab for analysis. Clinical analysis often requires the use of systems for metering, dispensing and mixing reagents with sample fluids. The sample fluids may include, for example, tissue samples, blood samples, urine samples or minute quantities of deoxy ribonucleic acid (hereinafter "DNA") sequences in a buffer fluid. Both manual and automated systems have been available for aliquoting the fluid samples and assaying the samples with one ore more reagents. Manual systems have historically included the glass capillary pipette, the micropipette, precision syringes and weighing equipment. A variety of biological assays have been and continue to be conducted with manual equipment of the type described.

Typical methodologies, which require that the sample be distributed in a serial manner, are cumbersome. There remains a need for an apparatus and method capable of distributing a fluid sample to multiple containers evenly by a single process at the same time.

Thus, there is a present need for an automated system capable of dispensing a predetermined amount of liquid into multi-well plates and the like which is accurate, quick, and if required, preserves the sterility of the sample being dispensed for processing and/or storage.

SUMMARY OF THE INVENTION

Figure 1:
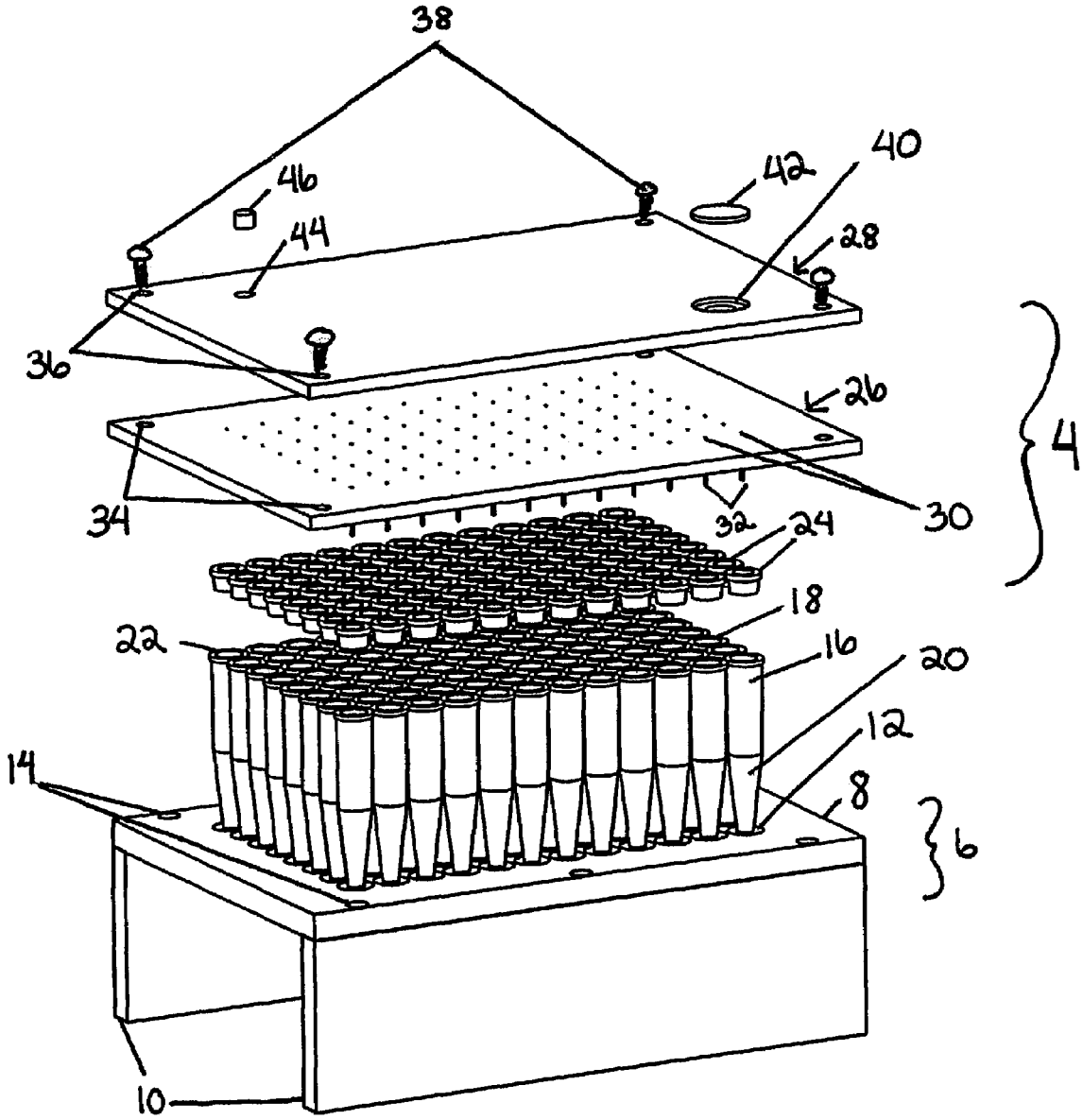
FIG. 1 is a perspective expanded view of an embodiment of a self-aliquoting device according to the invention.

The present invention relates to a sample dispensing unit and method for processing a sample, such as a biological sample, and more particularly to a self-aliquoting sample dispensing assembly having a storage unit and a dispensing unit arranged at a top thereof. The storage unit includes multiple receptacles into which a sample may be dispensed and a sealing member for providing an air tight seal between receptacles of the storage unit and ambient air. The sealing member includes an access member for providing a sample to be dispensed from the dispensing unit to the storage unit. The device and method function using temperature change to generate a pressure differential in the receptacles which pulls a predetermined amount of sample into each receptacle. The vacuum or a combination of vacuum and gravity enable the assembly to dispense a sample substantially equally among receptacles.

The present invention applies not only to certain fields within the chemical industry such as biotechnology, biochemistry and the like, but is also suitable for carrying out research in biological chemistry, inclusive of microbiology, or various kinds of chemical reaction tests such as a clinical diagnosis.

A self-aliquoting dispensing unit for use with a multi-receptacle storage unit is provided including: a lower plate having a plurality of access ports therethrough wherein at least one of the access ports is in fluid communication with a microtube; an upper plate releasably attached to the lower plate with the upper plate including a sample port for supplying a sample to the dispensing unit; and a sealing member for forming a reversible air tight connection between the storage unit and the upper plate.

Also provided is an assembly for dispensing a sample to a plurality of receptacles. The assembly includes a self-aliquoting dispensing unit and a storage unit in fluid communication with the dispensing unit. The dispensing unit includes a lower plate having a plurality of access ports therethrough, wherein at least one of the access ports is in fluid communication with a microtube, an upper plate releasably attached to the lower plate, the upper plate including a sample port for supplying a sample to the dispensing unit, and a sealing member for forming a reversible air tight connection between the storage unit and the upper plate.

Additionally, a method of dispensing a sample into a storage unit having a plurality of receptacles is provided including the steps of: adding a sample to a dispensing unit, attaching the storage unit to the dispensing unit to form an assembly, and creating a temperature generated vaccum in the receptacles of the storage unit to dispense an aliquot of the sample into each of the receptacles. The dispensing unit includes a lower plate having a plurality of access ports therethrough, wherein at least one of the access ports is in fluid communication with a microtube, an upper plate releasably attached to the lower plate, the upper plate including a sample port for supplying a sample to the dispensing unit, and a sealing member for forming a reversible air tight connection between the storage unit and the upper plate.

A kit for processing a sample is provided, including a dispensing assembly and reagents for processing a sample. The dispensing assembly includes a lower plate having a plurality of access ports therethrough, wherein at least one of the access ports is in fluid communication with a microtube; an upper plate releasably attached to the lower plate, the upper plate including a sample port for supplying a sample to the dispensing unit; and a sealing member for forming a reversible air tight connection between the storage unit and the upper plate.

The dispensing unit of the invention is adapted to allow chemical reaction in a receptacle so that a reaction test, for example, may be made in a simple and efficient manner.

It is an advantage of the present invention, that a dispensing unit for multi-receptacle storage units is provided which is disposable and can be used in single-use applications and then discarded.

It is a further advantage of the present invention that a dispensing unit is provided which may be maintained in a sterile condition during use.

An additional advantage of the present invention is the ability to fill a large number of receptacles with a predetermined amount of sample substantially simultaneously in one operation.

Yet a further advantage of the present invention is the ability to refrigerate or cryogenically freeze the storage unit for long-term use. In addition, the receptacles can be permanently affixed to the storage unit, removably attached to the storage unit or held in place by the storage unit and easily removed for further use. Most notably, is that the user can remove an individual receptacle for experimentation without disturbing the fluid sample in other receptacles.

Yet a further advantage of the present invention is that a dispensing unit having high precision and small volume fluid processing capability that can precisely aliquot small volumes of a sample fluid is provided.

Yet a further advantage of the invention is that a dispensing unit, which can mix small aliquots of sample fluid with various discreet reagents is provided.

It is yet a further advantage of the present invention to provide a dispensing unit and method for mixing a sample with reagent, which provides a uniform mixing concentration, and has high reaction and mixing efficiency.

The substance of interest or sample being tested and/or evaluated with the method and apparatus of the present invention may include small or large molecules such as drugs, potential drug candidates, metabolites, pesticides, pollutants, and the like.

The substance of interest may be cells or cellular components or fragments such as polypeptides and proteins, polysaccharides, nucleic acids, and combinations thereof. Among nucleic acids, for example, are DNA, cDNA, gDNA, RNA, MRNA, tRNA, and combinations thereof.

Furthermore, the substance of interest may be a specific binding pair (sbp) and may be a ligand, which is monovalent (monoepitopic) or polyvalent (polyepitopic), synthetic or natural, antigenic or haptenic, and is a single compound or plurality of compounds which share at least one common epitopic or determinant site.

In addition, a cell bearing a blood group antigen such as A, B, D, etc., or an HLA antigen, cell membrane receptors may be a substance of interest.

With the foregoing and additional features in mind, this invention will now be described in more detail, and other benefits and advantages thereof will be apparent from the following detailed description when taken in conjunction with the accompanying drawings, in which like elements are identically numbered throughout the several views.

DETAILED DESCRIPTION OF THE PREFERRED EMBODIMENTS

The present invention provides a sample dispensing unit and method, which uses a temperature differential generated vacuum to draw a sample from a dispensing unit into multiple receptacles held in a storage unit. The vacuum or a combination of vacuum and gravity enable the assembly to dispense a sample substantially equally among receptacles.

The apparatus and method of the invention, which permit performance of chemical reactions on many samples each in a small quantity, is particularly useful in clinical diagnosis.

Fluid biological samples and other substances in solution are often stored by freezing. A sample of the frozen fluid will remain stable for extended periods as long as it is kept in the frozen state. Frequently these fluids are collected in relatively large quantities, ("collected samples"), and are used in smaller quantities, ("specimens"), over an extended period of time. When a specimen is needed, it often requires thawing the entire collected sample to obtain the specimen currently needed, and then refreezing the remainder of the collected sample. However, frequent freezing and thawing cycles are almost always detrimental to the unstable ingredients in the collected sample. Further, when, for example, the blood of a patient is used as a sample, as tests on a given volume of blood have to be made for many items, the volume of blood to be used for one item is gradually reduced. However, the aforementioned apparatus, which contains multiple receptacles each having an equal amount of a biological sample, has an advantage in that it permits each receptacle to be used as needed.

In one aspect of the invention, it is possible to store samples in multiple small individual receptacles, permitting the thawing of individual receptacles without having to thaw and refreeze the entire collected sample.

The present invention is directed to a sample dispensing unit and the method for its use. A partial vacuum is created to move the liquid sample, typically blood, into the receptacles to permit one or more analytes or characteristics of the sample to be measured, typically optically or electrochemically, or by other conventional means. The dispensing unit and method for using same permits component measurements using a small liquid sample volume, allows accurate control over the proportion of the liquid sample to reagent, provides for simplicity of use, and accommodates disposability thereof.

A primary advantage of the invention is its simplicity. It is simple in construction and thus is relatively inexpensive to produce.

Additionally, the proportion of any reagent to the liquid sample size can be accurately controlled for subsequent accurate and consistent measurement.

The sample dispensing assembly and method of the invention are especially well suited for dispensing biological samples for subsequent high throughout screening such as proteomics analysis.

Referring now to FIG. 1, a sample dispensing unit and storage unit assembly according to the present invention is shown. The storage unit, indicated generally by the reference numeral 6, includes a storage plate 8 for storing sample receptacles or wells 16 and a support member 10 for supporting the storage plate 8. The support member 10 includes a pair of substantially parallel rectilinear elements arranged toward two opposed outside edges of the storage plate 8.

The storage plate 8 is substantially perpendicular to the support member 10 and may include 96 orifices 12 in an 8 by 12 array sized to fit 96 receptacles 16 therein. Toward each corner of the storage plate 8 are securement apertures 14 for connecting the storage unit 6 to the dispensing unit 4.

In FIG. 1, the receptacles 16 are shown as generally tubular containers having an opening 18 at a top thereof and a closed rounded narrowing tip 20 at the base thereof. The opening 18 is adapted to retain the receptacles 16 in their associated orifices 12 in the storage plate 8, in this case having a circumferential lip 22 which overhangs the orifice 12. The opening 18 of each receptacle 16 is fitted with a cap 24 to form an air tight seal to the receptacle 16.

Figure 7:
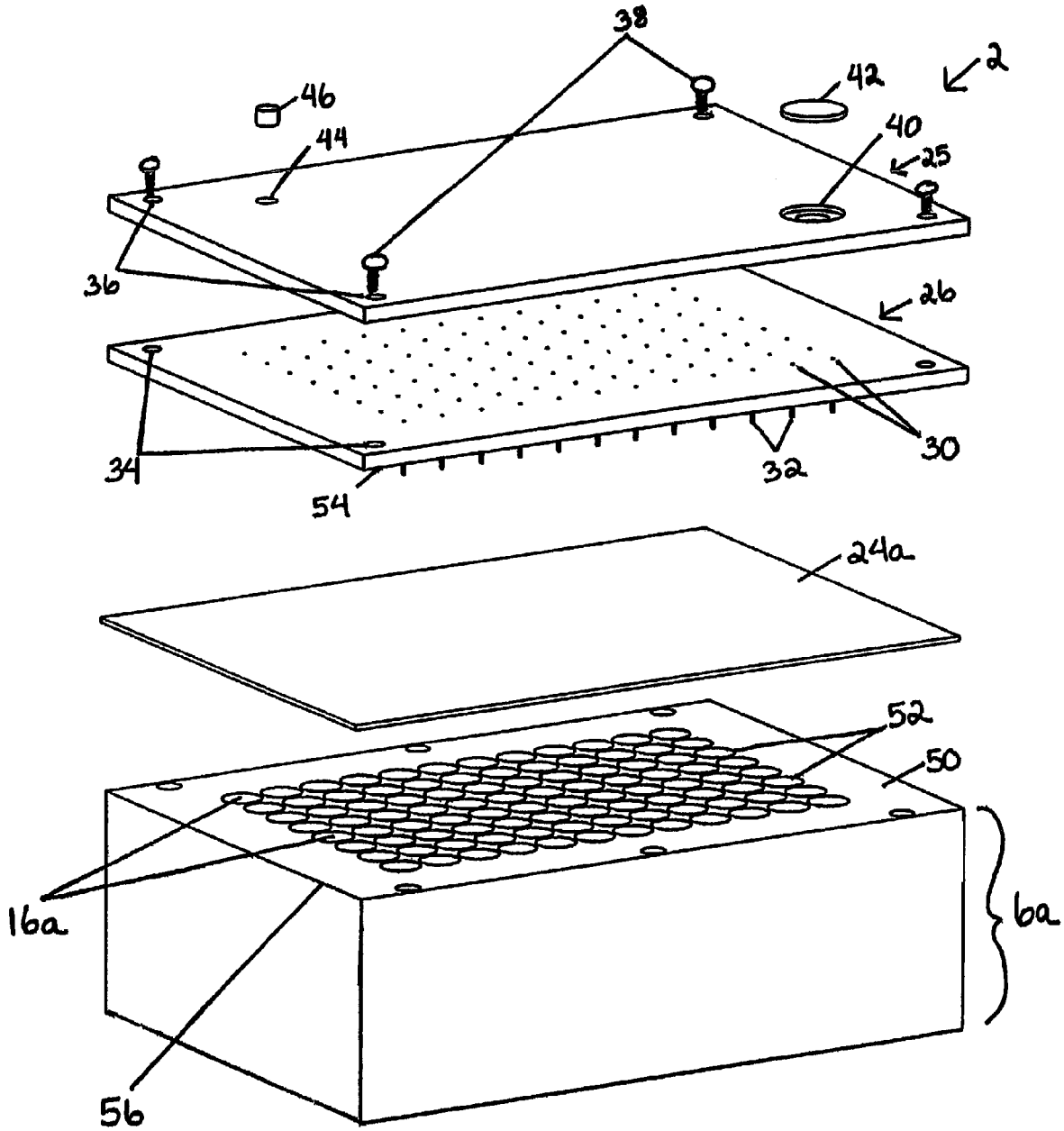
FIG. 7 is an exploded perspective view of an alternative embodiment of a self-aliquoting device according to the invention including wells that are integral with the storage plate.

It is also possible for the receptacles 16, storage plate 8 and support member 10 to be made integral. Referring to FIG. 7, the storage unit 6 is shown having wells **16*a* bored into a solid material which functions also as the storage plate 6*a*** and support member, as is the case with some conventional microtiter plates.

It is to be understood that although an 8×12 array is shown, any number of receptacles of any size and configuration may be used. For example, the storage plate may be a 2×6 array, or other arrangement. In a desirable aspect of the invention, the storage unit conforms to Society for Biomolecular Screening (SBS) standards for microplates and the dispensing unit according to the invention is sized to be compatible with. As a result, it will be possible to use the dispensing unit of the invention with conventional microplates which also conform to these specifications.

The dispensing unit, generally referred to by reference number 4, includes a lower plate 26 and an upper plate or lid 28. The dispensing unit 4 includes a sealing member 24, including receptacle caps, for providing an air tight seal between the air in each of the receptacles and ambient air. In this case the combination of the plates 26 and 28 and the receptacle caps 16 serve as the sealing member.

The lower plate 26 is substantially planar with a perimetric geometry substantially corresponding to that of the storage plate 8. The lower plate 26 includes a plurality of access ports 30 therethrough, wherein each access port is associated with a receptacle into which a sample will be dispensed. Each access port 30 is in fluid communication with a microtube 32 extending downward toward a base of the receptacle for dispensing the sample thereto. The lower plate 26 is provided with a plurality of securement apertures 34 therethrough for connecting the dispensing unit 4 to the storage unit 6.

The shape of the microtubes 32 is not critical, although cylindrical is preferred. The ends of the microtubes may be sharp or blunt depending on their ability to pierce the particular material selected for use in the caps. The diameter of the microtubes is not critical. The diameter of the microtubes should be small enough so that the surface tension created by the sample is sufficient to resist sample from flowing through the microtubes and into the receptacles before creation of a temperature differential induced vacuum. The microtubes should be large enough so that a liquid will not take an extended period of time to fill the receptacles.

The upper plate or lid 28 includes a securement member for attaching the lid 28 to the lower plate 26 and/or the storage unit 6. In FIG. 1, a lid 28 is shown having a plurality of securement apertures 36 therethrough for connecting the lid 28 to the lower plate 26 and the storage unit 6. The lid 28 is substantially planar, with a perimetric geometry substantially corresponding to that of the lower plate 26 and the storage unit 6. The securement apertures 14, 34 and 36, are arranged so as to be in alignment when the dispersing unit 4 and the storage unit 6 are aligned for assembly. Screws 38 are shown above each of the securement apertures for connecting the dispensing unit 4 to the storage unit 6. Although screws and securement apertures are shown, it is to be understood that any equivalent fastening structure may be used for making the connection. It is also possible to include a conventional gasket between the dispensing unit and the storage unit.

The lid 28 includes a sample port 40 therethrough for supplying the sample to be dispensed. A plug 42 is provided on a top side of the lid 28 for closing the sample port 40 when it is not in use. A vent hole 44 creates a channel through the lid for allowing pressure to equilibrate between pressure in the receptacles and pressure external to the assembly 2 of the dispensing unit 4 and the storage unit 6. The vent hole may be provided with a vent hole plug 46. The plugs may be made of any suitable elastomeric material, such as natural rubber elastomers, synthetic thermoplastics, and thermoplastic elastomeric materials.

Figure 2:
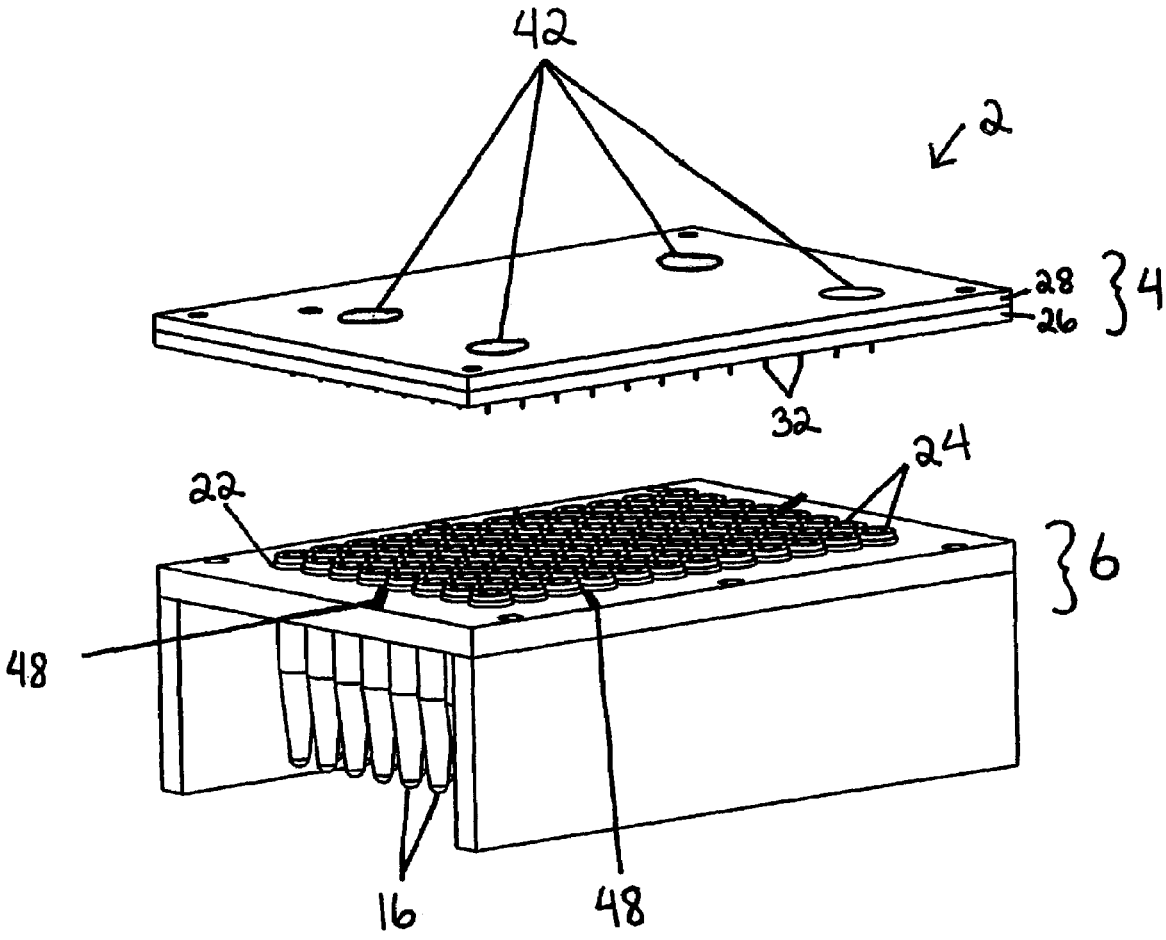
FIG. 2 is a perspective partially expanded view of a self-aliquoting device according to the invention.
Figure 3:
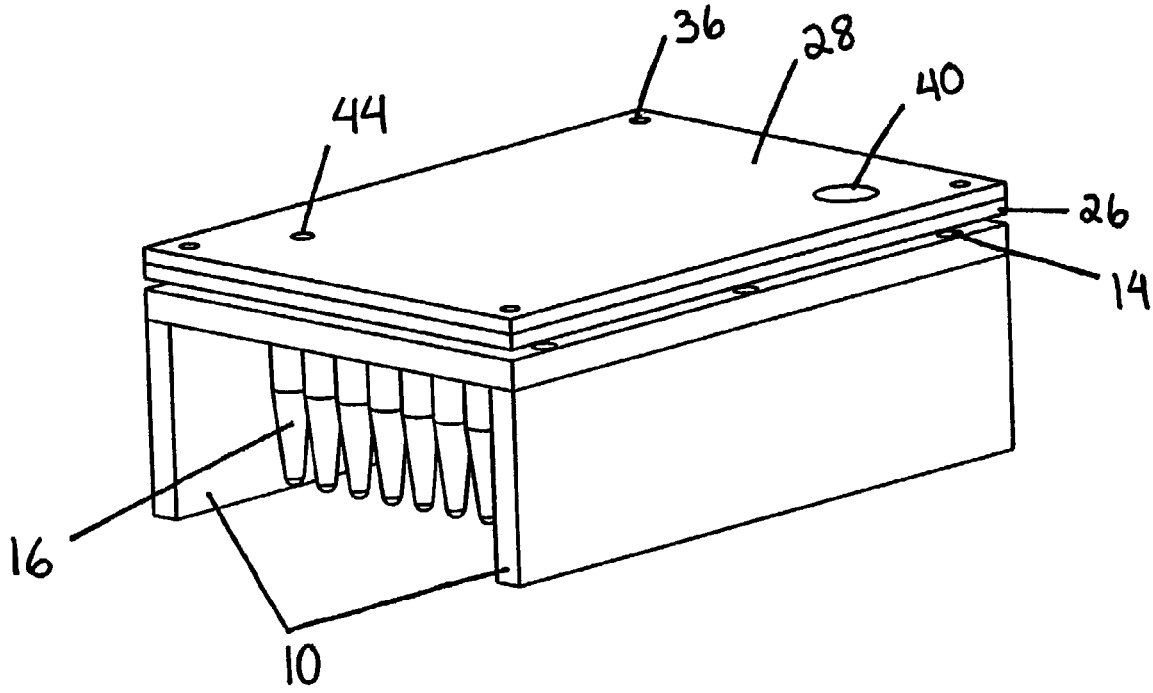
FIG. 3 is perspective view of a self-aliquoting device according to the invention in an assembled form.

Referring now to FIGS. 2 and 3, perspective views of the assembled dispensing unit 4 arranged above the assembled storage unit 6 and receptacles 16, are shown. The dispensing unit 4 is shown with the lower plate 26 in contact with the lid 28. In FIG. 2, the microtubes 32 are visibly protruding from the bottom of the dispensing unit 4.

In one aspect of the invention the dispensing unit 4 and the storage unit 6 are supplied separately. In this case, it is possible for a user to pre-treat the receptacles 16 as required before connecting the units to form the assembly 2. For example, it will be possible to add a protease inhibitor into the receptacles 16 prior to adding a blood sample so as to inhibit degradation of the sample. Additives including cationic compounds, detergents, chaotropic salts, ribonuclease inhibitors, chelating agents, quaternary amines, and mixtures thereof, also may be provided in the receptacles prior to addition of sample. Chemical agents can be included to permeabilize or lyse cells in the biological sample. Suitable additives include, but are not limited to, phenol, phenol/chloroform mixtures, alcohols, aldehydes, ketones, organic acids, salts of organic acids, alkali metal salts of halides, additional organic chelating agents, fluorescent dyes, antibodies, binding agents, anticoagulants such as sodium citrate, heparin, and the like, and any other reagent or combination of reagents normally used to treat biological samples for analysis.

In a further aspect of the invention, at least one of the lower plate 26 and the storage plate 8 also includes a separating member 48 for dividing the assembly into a plurality of sections that are air tight with respect to one another. In this case, there will be additional access ports 42 for supplying the sample for each of the sections. For example, it is possible for the unit to be divided into four air and liquid tight sections as shown in FIG. 2. In this case, there will be four access ports 42 for addition of a sample. As a result, a single microtiter plate may be used to provide four different samples into four groups of receptacles. Although four sections are show, it is understood that any number of separate sections may be made.

Furthermore, it is possible to use the invention to dispense sample into less than the entire number of receptacles. For example, it is possible to remove some of the receptacles so that their associated microtubes are exposed to the ambient air. In this case, the sample will not be drawn out of the microtubes because the surface tension of the sample will avoid liquid from freely flowing out of the microtube and, without the air tight attachment of an associated receptacle, there will be no pressure differential for drawing out the sample. Alternatively, fewer microtubes than receptacles may be provided. In this case as well, air tight attachment is prevented and no pressure differential will exist for drawing out the sample.

Under normal use conditions, the dispensing unit will remain level during the distribution process. For example, when used on a bench top or in a refrigerator, each of the microtubes will remain on a plane such that they are even or level with one another. However, in the event the assembly is not retained in a level position during the distribution process, it would be advantageous for the dispensing unit to resist uneven distribution of sample across the surface of the lower plate. Therefore, in a desirable aspect of the invention, the distribution unit 4 includes a member for evenly distributing the sample across the surface of the lower plate 26 before the sample is dispensed.

Figure 4:
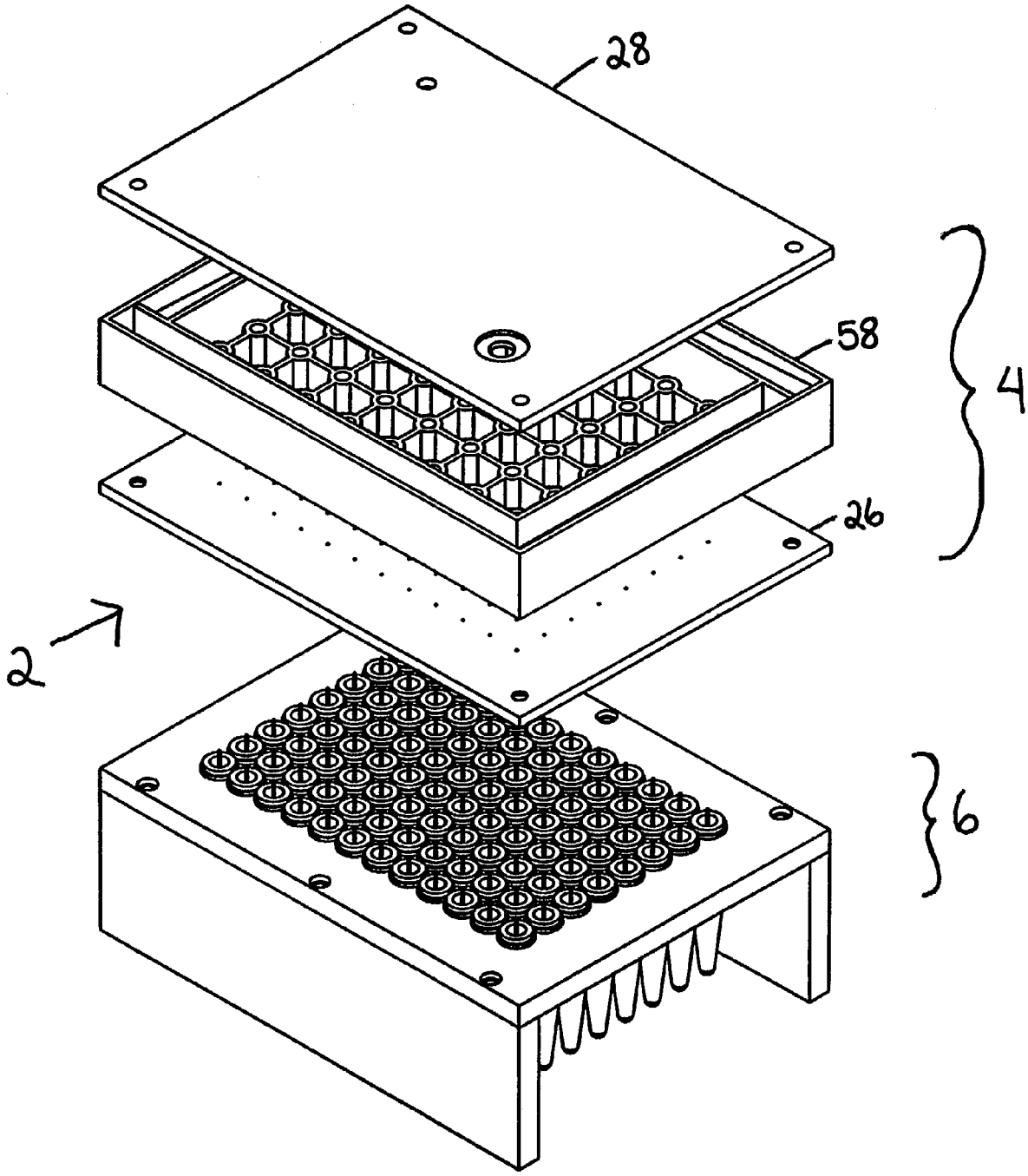
FIG. 4 is a perspective expanded view of an alternative embodiment of a self-aliquoting device according to the invention which includes a distribution plate.
Figure 5:
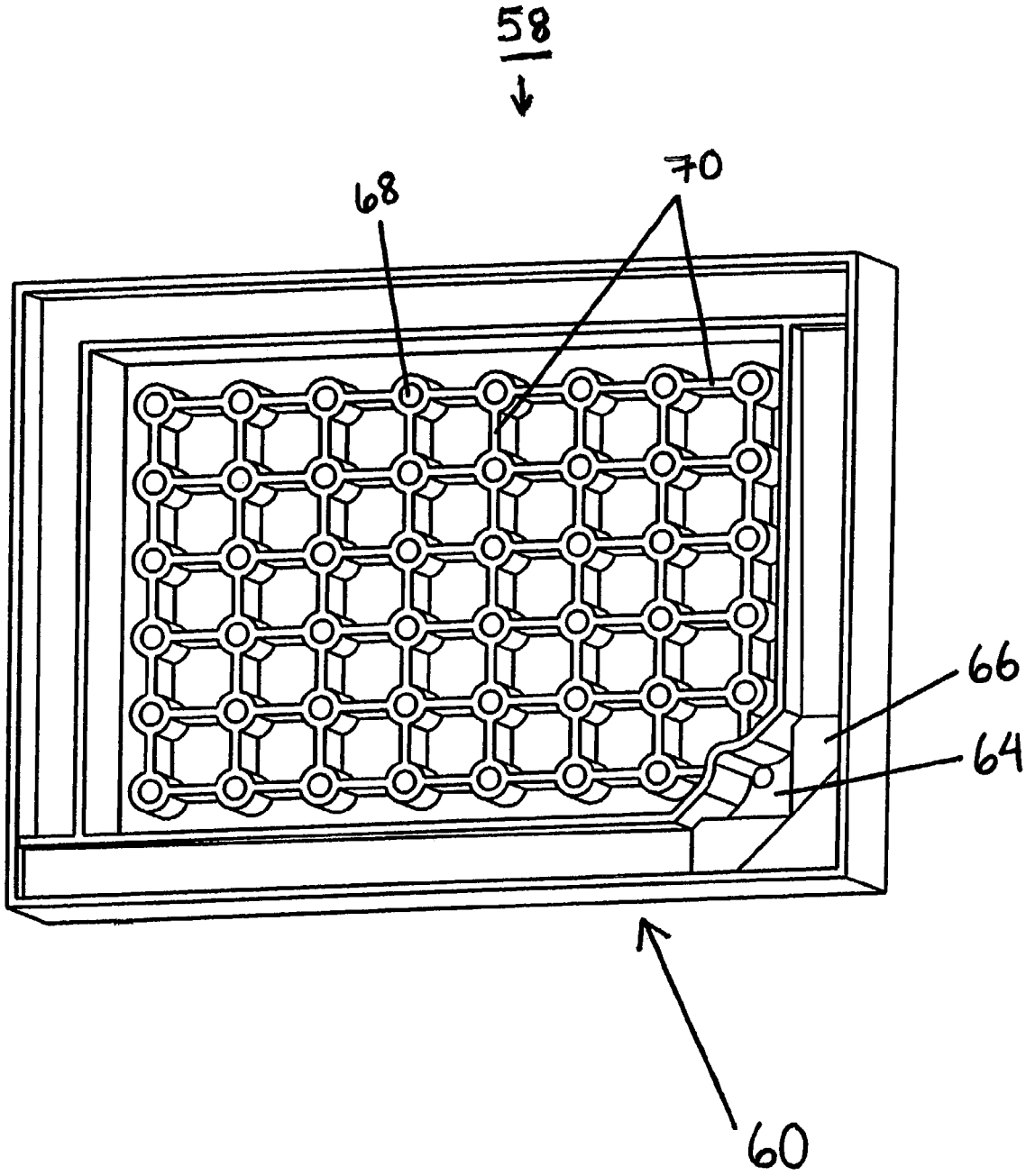
FIG. 5 is a top perspective view of an alternative embodiment of the present invention which includes a sample distribution plate.
Figure 6:
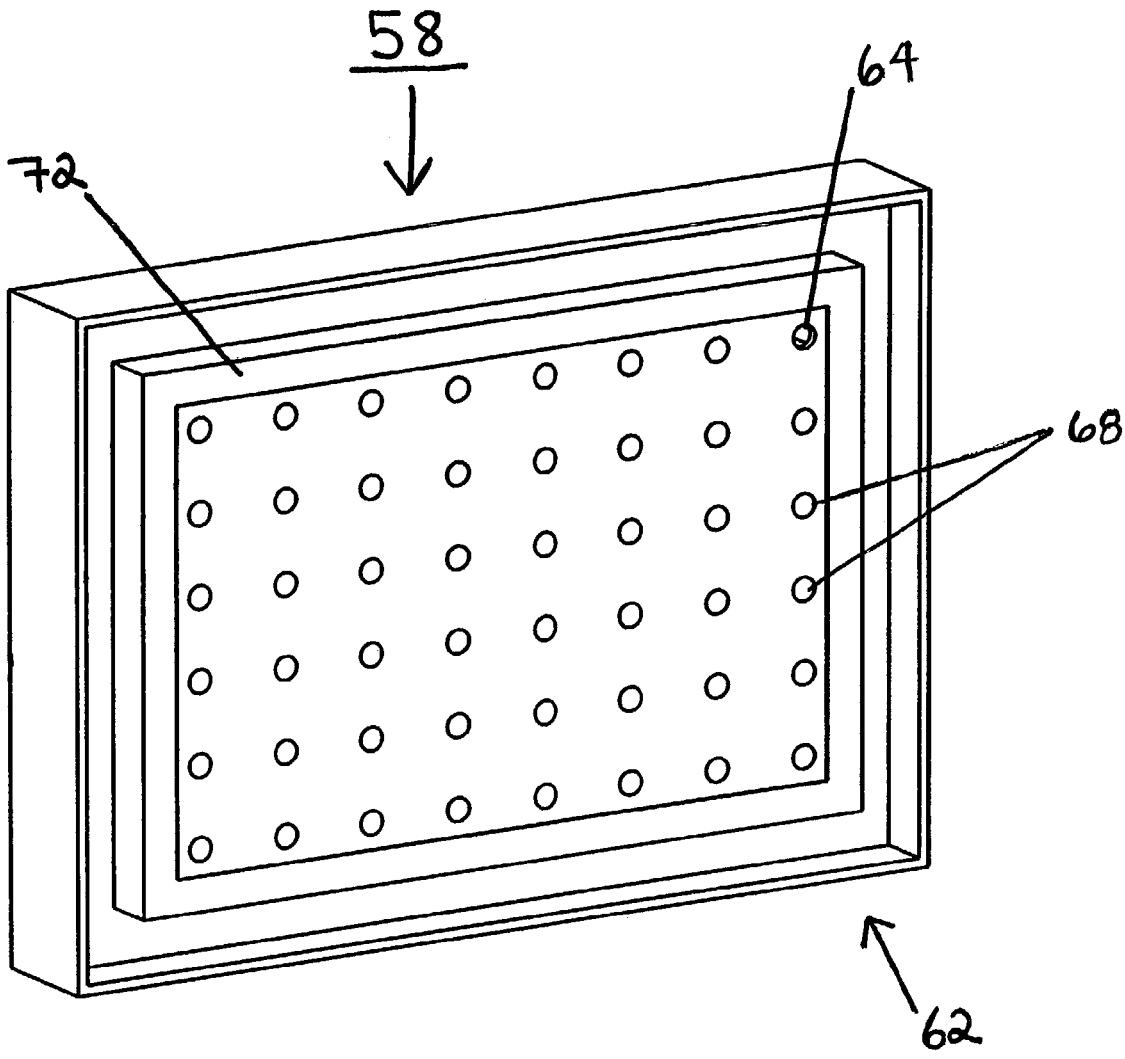
FIG. 6 is a bottom perspective view of an alternative embodiment of the present invention including a sample distribution plate.

Referring now to FIGS. 4, 5 and 6, an alternative aspect of the invention is shown including a distribution member. The upper plate 28, lower plate 26, and storage unit 6, are as described previously. However, in this aspect, a distribution plate 58 is interposed between the upper plate 28 and the lower plate 26. The distribution plate 58 allows for even distribution of the sample across the surface of the lower plate 26 even if the dispensing assembly is oriented so that the microtubes are not level with one another. The distribution plate 58 has an upper surface 60 and a lower surface 62.

Referring again to FIG. 5, the upper surface 60 of the distribution plate 58 is shown. The upper surface 60 includes a distribution port 64 for passage of the sample from the sample port 40 of the upper plate 28 to a top surface of the lower plate 26. A diverting member is provided to direct flow of the sample, in this case in the form of a ramped trough 66 provided toward an outer perimeter of the distribution plate 58. The arrangement of the sample port 40 with respect to the distribution plate 58 is not critical, except it should be above a portion of the ramped trough 66 so as to facilitate flow of the sample into the distribution port 64.

The upper surface 60 includes a plurality of distribution cells 68 which comprise a series of hollow channels. The number of distribution cells 68 is not critical so long as they are distributed in a regular or semi-regular pattern uniformly or semi-uniformly across the portion of the distribution plate 58 inside the trough 66. In addition, a plurality of reinforcing elements 70 are arranged between the cells 68. There is no particular limitation to the number or arrangement of the reinforcing elements 70, so long as the cells 68 are reinforced so as to maintain their position with respect to one another. Once the sample is diverted to the distribution port 64, it is then distributed evenly across the lower surface 62 of the distribution plate 58.

Referring now to FIG. 6, the lower surface 62 of the distribution plate 58 is shown. The lower surface includes a capillary channel 72 which is sized to draw the sample along the channel 72 by capillary action. There are no particular limitations as to the location and number of channels 72, so long as the sample is drawn across the portion of the lower surface 62 having distribution cells 68. Desirably, the channel is from about 0.5 mm to about 0.005 mm across. More desirably, the channel is about 0.25 mm across. The channel 72, if it is normally hydrophobic, may be treated so as to render it more amenable to moving liquid in a capillary action. Such treatments are known in the art and may include, among others, coating the surface with a surfactant or wetting agent, grafting a layer of hydrophilic polymer onto the surface, or treating the walls by plasma etching or corona treatment.

In operation, the sample is drawn across the lower surface 62 by capillary action. Once the sample is drawn across the lower surface 62, it then has access to the distribution cells 68. By an equilibrating process, each of the cells 68 fill to approximately the same level. At this point, the sample is evenly distributed across the lower surface 62 of the distribution plate 58 by virtue of having been drawn up into the cells 68. In addition, the sample is distributed across a top surface of the lower plate 26 of the dispensing unit 4 and is ready to be dispensed into the receptacles 16.

Referring now to FIG. 7, an advantageous aspect of the invention is shown in which a dispensing unit 4 according to the invention is used in combination with a conventional storage unit. In this aspect, the receptacles are wells 16*a* which are integral with the storage unit, which in this case is a conventional microtiter plate 6*a*. An array of, in this case, 12×8 wells 16*a* are bored or otherwise formed into a substantially rigid microtiter plate 6*a*. An upper surface 50 of the microtiter plate 6*a* is substantially planar. The wells 16*a* have openings 52 at a top thereof for entry of a sample.

In this aspect, rather than each well 16*a* being fitted with an individual cap, the sealing function is performed by a film 24*a* septum. The film 24*a* is a substantially planar sheet made of elastomeric material which when arranged between the microtiter plate 6*a* and the dispensing unit 4 forms a gas tight seal over the openings 52 of the wells 16*a*. The film 24*a* is pierced by the microtubes 32 when assembled with the storage unit, in this case a microtiter plate 6*a*. As described previously, sample is dispensed into the wells when the temperature induced vacuum is generated.

Furthermore, in this aspect of the invention, the securement aperture for connecting the microliter plate to the dispensing unit may comprise a lip 54 arranged on a periphery of the lower plate 26 of the dispensing unit 4 to form an air tight friction fit with an edge 56 of the microtiter plate 6*a*. The lip 54 in combination with the film 24*a* forms an airtight connection between the dispensing unit 2 and the microtiter plate 6*a*. Optionally, an adhesive is applied to an inside of the lip 54 to further secure the dispensing unit 4 to the microtiter plate 6*a*.

Figure 8:
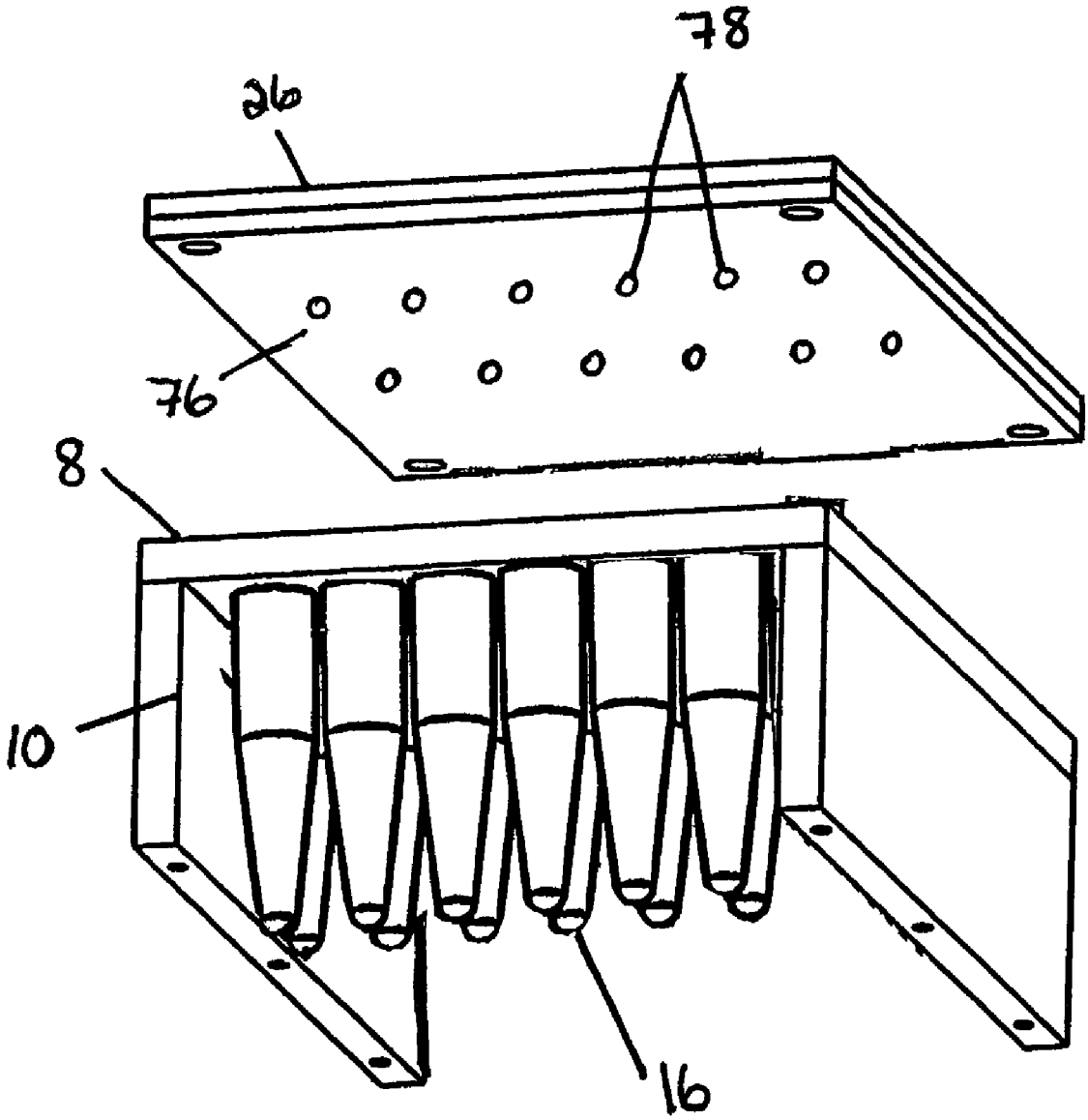
FIG. 8 is an exploded perspective view of an alternative embodiment of the present invention.

Referring now to FIG. 8, a further advantageous aspect of the invention is shown. In FIG. 8, the sealing means includes a perforated gasket 76 interposed between a lower surface of the lower plate 26 and an upper surface of the storage plate 8. In this aspect, each of the perforations 78 of the gasket 76 correspond to an individual receptacle 16 so as to create an air tight seal of the receptacles with their associated access ports 30. The gasket 76 replaces the microtubes 32 and caps 24 in performing the sealing function of the aspect of the invention shown in FIGS. 1-3 and the microtubes 32 and film 24*a* of the aspect of the invention shown in FIG. 7.

Optionally, the upper plate 28 may be used as the lid. When the embodiment using a gasket 76 to perform the sealing function is used, as shown in FIG. 8, then the receptacles will have to be capped prior to storage.

Figure 9A:
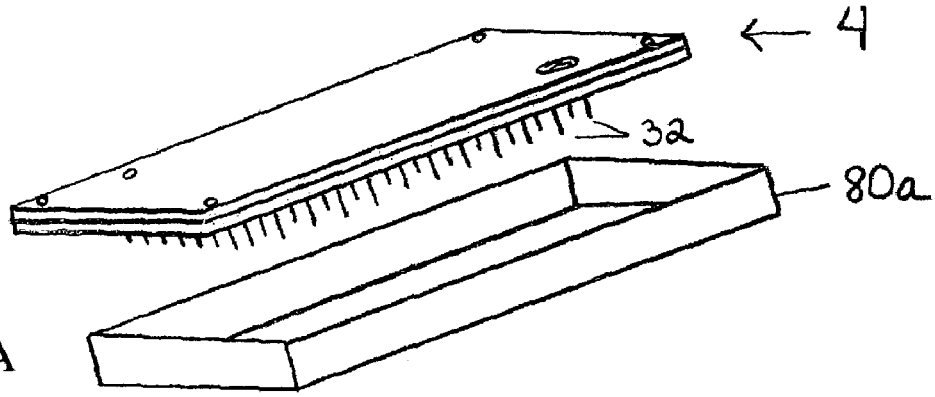
FIGS. 9A, 9B, and 9C are perspective views of embodiments of safety features of the present invention.
Figure 9B:
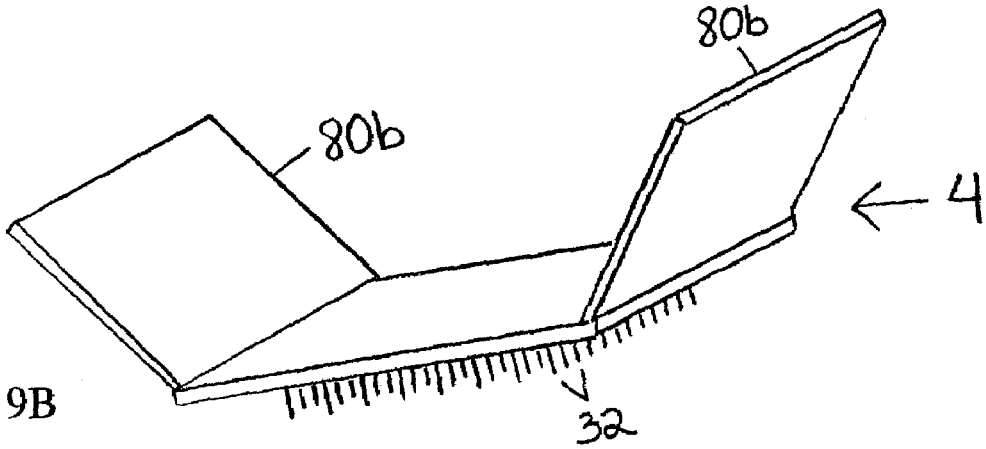
Figure 9C:
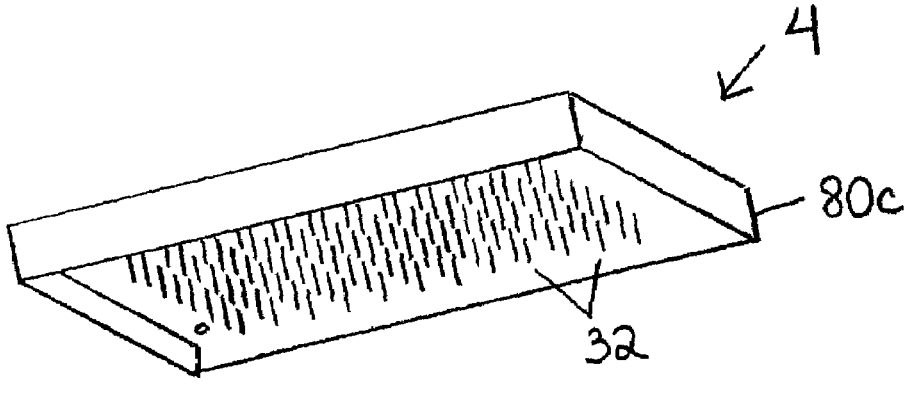

Once removed, the dispensing unit can be disposed of in accordance with legal requirements. If the sample contains biohazard materials, such as blood, then the ends of the microtubes may be guarded so as to avoid contact with any residual sample or sharp ends of microtubes using any suitable means. Referring now to FIGS. 9A-9C, embodiments of protective safety shields are shown. The shield, represented generally by the reference numeral 80, may be any of a variety of active or passive forms. In FIG. 9A, the shield 80*a* is a cover which fits over the microtubes 32. In FIG. 9B, the shield 80*b* includes a plurality of hinged flaps which are integral with the dispensing unit 4 and fold over to cover the microtubes 32. In FIG. 9C, the shield 80*c* is in the form of an extended perimetric skirt which reaches beyond any exposed edges of the microtubes 32. Each of the variously shown shields, including an extended rigid or semi-rigid skirt, an integral hinged cover, or a separate cover, are examples of safety features that may be added to the dispensing unit 4 for providing safety related protection.

The storage unit and the dispensing unit are desirably pre-assembled for use with the dispensing unit being installed onto the storage unit so that the microtubes have pierced the caps or film. The present invention also includes, therefore, an assembly 2 including dispensing unit 4 and storage unit 6. In one aspect of the invention, the assembly is provided with a solid, liquid or combination reagent in the receptacles.

Alternatively, the storage unit and the dispensing unit are assembled by a user prior to use. In this case, it is possible for the user to assemble the dispensing unit of the present invention with a conventional storage unit or microtiter plate. Additionally, a user may pre-treat an inside of the receptacles or wells prior to dispensing a sample therein.

There are no particular limitations to the design and construction materials of the assembly according to the invention. Preferably, the dimensions of the storage unit will comply with the Society for Biomolecular Screening (SBS) standards for microplates including standard SBS-1 Footprint Dimensions and standard SBS-4 Well Positions.

Robotics based high throughput tools are now routinely used to screen libraries of compounds, for example, to identify lead molecules for their therapeutic potential. The SBS standards are intended to serve as conformed industry standards in these types of assays to facilitate compatibility of equipment used therein. Because the distribution unit can be sized to conform to the aforementioned standards, it is possible to use the present invention in conjunction with existing robotic based methods used to automate handling of samples. See, for example, U.S. Pat. No. 5,104,621 to Pfost et al. Screening methods that can be performed using the dispensing assembly and method of the present invention include those discussed in U.S. Pat. No. 5,585,277 to Bowie et al.

With respect to the storage unit 6, the vertical support members 10 and the storage plate 8 may be constructed of a stainless steel or other rigid material such as plastic. The storage plate 8 may have any number of receptacles 16, however it is typical for 12, 96, 192, 384, or 1536 receptacle units to be used in biotechnology, drug discovery, and medical technology applications such as high throughput drug discovery applications.

The receptacles 16 may be constructed of any suitable material, desirably a polymeric material. Selection of the material will be based on its compatibility with the conditions present in the particular operation to be performed with the receptacles. Such conditions can include extremes of pH, temperature, and salt concentration. Additional selection criteria include the inertness of the material to critical components of an analysis or synthesis to be performed, such as proteins, nucleic acids, and the like. If conditions of handling the receptacles are expected to involve repeated freeze/thaw cycles, then polypropylene or high density polyethylene are preferred. Desirably, a translucent material such as polystyrene or polypropylene is used to form the receptacles, in order to allow a user to confirm proper fill level or to facilitate later spectroscopic or other detection.

Furthermore, it is desirable to provide the receptacles 16 with a bar code (not shown) toward a tip thereof for ease in identifying the sample contained therein. In applications involving multiple analyses being conducted on an individual or multiple samples, it is important to be able to track the sample including the date collected, source, technician, reagents, and the like. In addition, significant events after initial collection can be tracked including number, type, date of repeat analyses, freeze/thaw cycles, transport of the sample, and the like. The bar code can be used in conjunction with available software to track and develop reports on the data collected from the samples.

The caps 24 or film 24*a* may be formed of any suitable elastomeric material capable of forming an air tight seal when pierced by the microtube 32. Furthermore, the gasket 76 may be made of any suitable elastomeric material capable of forming an air tight seal between the dispensing unit 4 and the receptacles 16. Desirably, the caps, film or gasket are formed of an ethylene vinyl acetate (EVA) or a silicone rubber. One commercially available product suitable for use as a cap is the pierceable Capmat M5300 (Micronic BV, Lelystad, NE).

Furthermore, there are no particular limitations to the materials used to form the dispensing unit 4. For example, the upper plate 28, distribution plate 58, and lower plate 26 and microtubes 32 may be formed of any substantially rigid material. Particularly desirable are polymeric materials such as plastics. Non limiting examples of plastics that may be used include polycarbonate, polystyrene, polytetrafluoroethylene, polyvinyl chloride, polydimethylsiloxane, and the like.

The lower plate 26 may be formed with appropriately spaced holes according to known methods. Microtubes 32 may be formed separately of a suitably rigid material such as an elastomer or the like, and be either pressed into the access ports 30 in the lower plate 26 or bonded to the access ports 30 using any suitable material, for example, an adhesive. The lid 28 may similarly be formed with any appropriate material, which can be the same or different from that used in forming the lower plate 26. Desirably, the lid 28 will be made of a translucent or transparent plastic material so that a visual confirmation of distribution of the sample across the entire surface of the lower plate 26 can be made.

The parts of the dispensing unit 4 may be fabricated using any suitable means, including conventional molding and casting techniques, extrusion sheet forming, calendaring, thermoforming, and the like. For example, with apparatus prepared from a plastic material, a silica mold master, which is negative for the lower plate, can be prepared by methods generally known in the art. A liquefied polymer may then be added to the mold to form the part.

The function of the dispensing unit relies on a practical application of the Ideal Gas Law:

$$PV=NRT$$

wherein:

P=pressure

V=volume

N=number of moles

R=ideal gas constant=0.08206 liters-atm/g-moles-° K=1543 $ft^3$-lb/$ft^2$/lb moles-° R T=absolute temperature (° K or ° R)

In the present invention, a pressure differential within the receptacles is created between the time the assembly is filled with a sample and the time the sample is to be dispensed. At the time of filling the dispensing unit with a sample, the pressure within the receptacles is related to the ambient temperature, for instance, that present in a laboratory hood or on a laboratory bench. Once the dispensing unit is filled at this first temperature, the assembly is then exposed to a cooler temperature. By exposing the assembly to a colder temperature, for example by placement into a refrigerator or freezer, the air inside the receptacles becomes colder. In accordance with the Ideal Gas Law, since the volume of the receptacles, the number of moles of gas within the receptacles, and R are each constant, the pressure within the receptacles is reduced commensurate with the temperature differential between the air outside the freezer and the air inside the freezer. This pressure reduction produces the vacuum which then pulls the sample substantially simultaneously through the plurality of microtubes and into the receptacles.

Deriving from the Ideal Gas Law, when N is constant, the product of a first pressure and a first volume divided by a first temperature will be equal to the product of a second pressure and a second volume divided by a second temperature, as follows:

$$P_1V_1/T_1=P_2V_2/T_2$$

It is therefore possible to predetermine the temperature differential required to obtain a desired volume of a sample to be dispensed into each receptacle. First, the final volume of gas remaining in the receptacle when the proper volume of liquid has been dispensed must be determined. By subtraction, the total volume of the receptacle minus the desired volume of the filled receptacle, equals the volume of gas $V_2$ that will remain in the receptacle after it has been filled to the desired volume. The pressures $P_1$ and $P_2$ will be equal after the sample has been dispensed, and therefore may be removed from the equation.

As a result, starting with a given known temperature $T_1$, where the original volume of the empty receptacle is assigned $V_1$, the temperature $T_2$ necessary to achieve the desired end volume $V_2$ of gas in the receptacle is determined according to the following formula:

$$T_2=T_1V_2/V_1$$

It is possible, therefore, by performing a simple calculation, to determine the temperature differential required to achieve the desired fill volume of the receptacles.

Since the pressure differential is substantially the same throughout the entire assembly, substantially the same volume of sample will be dispensed into each of the receptacles. The receptacles are filled substantially simultaneously, the rate of which is related in part to how quickly the vacuum is produced.

There are no particular limitations to the temperatures that may be used. As long as it is possible for the sample to flow through the microtube, the dispensing unit will be able to perform its function. Therefore, the range of possible and optimal temperatures will be determined by the needs of the particular samples in question. For example, certain viscous samples will become more viscous in cooler temperatures. As a result, it is advisable to use higher temperatures for creating the pressure differential when dispensing more viscous samples. In addition, temperatures below freezing (32° F.; 0° C.) can cause many liquid samples to begin to crystallize. For these susceptible samples, it is advisable to use temperatures above freezing if the time necessary to create the required pressure differential is so long as to approach the time it takes for the samples to begin to freeze. The necessary temperature restrictions will be readily apparent to those having ordinary skill in the art.

The time necessary to dispense a sample into the receptacles varies depending on the capacity of the surrounding media to change the temperature of the receptacles. For example, water is a more conductive medium for generating a temperature change than is air. As a result, for a given fill volume, it will take longer to produce the necessary pressure differential by placing the assembly from ambient air into a refrigerator at a given temperature than by placing the assembly into a water bath of the same temperature.

Any manner of generating a temperature derived pressure differential is within the contemplation of the present invention. Therefore, although lowering the sample temperature from ambient to that of a refrigerator or freezer has been contemplated, it is equally possible to heat the storage unit or the assembly to above room temperature, for example using a water bath, before addition of the sample. The assembly may then be allowed to cool to room temperature. The samples may be transferred from one elevated temperature bath to a lower temperature bath, such as an ice bath. This operation may be performed, for example, in a sterile hood.

In a method according to the invention, an assembly of a dispensing unit and a storage unit is filled with a sample to be dispensed. A pressure differential is generated by reducing the temperature of the assembly. The assembly is then allowed to equilibrate to the lower temperature and dispense a sample into the receptacles.

Additionally, the dispensing unit may be replaced after a first dispensing event to allow for sequential additions of samples into the receptacles or wells.

In one aspect of the invention, a method is provided for dispensing a sample in a high throughput assay including the steps of adding a reagent to a multi-receptacle storage unit, assembling a dispensing unit and the storage unit into an assembly, adding a sample to the dispensing unit, and creating a temperature generated vacuum in the receptacles of the storage unit to dispense an aliquot of the sample into each of the receptacles. The sample may be analyzed after the aliquots have been dispensed. Alternatively, the samples may be stored for later analysis. Desirably, the reagent is a protease inhibitor.

The dispensing assembly and methods of the invention may be used in any of the known assay methods for analyzing samples which call for multi-receptacle handling, i.e., in which microplates are used. Non-limiting examples of such analyses include Sanger sequencing, blotting techniques, microplate assays, polymerase chain reactions, hybridization reactions, immunoassays, generating combinatorial libraries and proteomics.

After use, the dispensing unit can be removed from the storage unit. The sample unit may then be used for further handling and analysis, or to store the samples, for example in a cryogenic freezer, or the like. There is no need to transfer the sample to another receptacle for analysis or storage. When the embodiment directed to a storage unit having wells instead of tubular receptacles is used, then a lid may be placed on top of the storage unit prior to storage.

Another aspect of the present invention includes a kit for processing a sample. In one desirable aspect, a kit includes a dispensing assembly as described above and reagents for processing a sample. The reagents for the kits may be supplied already dispensed in or coated on the surface of the receptacles or packaged in a separate container or containers. The reagents may each be in separate containers or various reagents can be combined in one or more containers depending on the cross-reactivity and stability of the reagents. Desirably, the reagents include a protease inhibitor.

Under appropriate circumstances one or more of the reagents in the kit can be provided as a dry powder, usually lyophilized, including excipients, which on dissolution will provide for a reagent solution having the appropriate concentration for performing a method or assay in accordance with the present invention. The kit can also include additional reagents depending on the nature of the method for which the kit is used. For example, the kit may include solid phase extraction materials including paramagnetic beads and non-magnetic particles, lysis solutions, wash and elution and running buffers, bio-molecular recognition elements including receptors, enzymes, antibodies and other specific binding pair members, labeling solutions, substrates, reporter molecules, sample purification materials including membranes, beads, and the like. Included in the kit may also be additives such as cationic compounds, detergents, chaotropic salts, ribonuclease inhibitors, chelating agents, quaternary amines, and mixtures thereof, may be provided in the receptacles prior to addition of sample. In addition, chemical agents can be included to permeabilize or lyse cells in the biological sample.

The kit may include additional additives including but not limited to phenol, phenol/chloroform mixtures, alcohols, aldehydes, ketones, organic acids, salts of organic acids, alkali metal salts of halides, additional organic chelating agents, anticoagulants such as sodium citrate, heparin, and the like, and any other reagent or combination of reagents normally used to treat biological samples for analysis.

It will be apparent that the present invention has been described herein with reference to certain preferred or exemplary embodiments. The preferred or exemplary embodiments described herein may be modified, changed, added to, or deviated from without departing from the intent, spirit and scope of the present invention.

What is claimed is:

1. A method of dispensing a sample into a storage unit having a plurality of receptacles, said method comprising the steps of:

adding a sample to a dispensing unit, said dispensing unit including:

a lower plate (26) having a plurality of access ports therethrough, wherein at least one of said access ports is in fluid communication with a tubular microtube (32) extending from, and having a longitudinal axis disposed transversely to, said lower plate; and an upper plate (28) releasably attached to said lower plate, said upper plate including a sample port extending therethrough for supplying a sample to said dispensing unit, wherein said sample port is located spaced from, so as to not overlie, at least a portion of said access ports;

wherein a liquid flow path is defined between, and generally parallel to, said upper and lower plates to permit communication between said sample port and said access ports; and creating a temperature generated vacuum in said receptacles of said storage unit to dispense an aliquot of said sample into each of said receptacles.

2. The method of claim 1, further comprising the step of adding a reagent to said storage unit.

3. The method of claim 2, wherein said step of adding said reagent is performed before adding said sample to said dispensing unit.

4. The method of claim 3, wherein said reagent is a protease inhibitor.

5. The method of claim 1, wherein each said access port includes a microtube.

6. The method of claim 1, wherein said dispensing unit further comprises securement means for securing said lower plate to said upper plate.

7. The method of claim 6, wherein said securement means comprises:

at least one threaded aperture in said upper plate;

at least one corresponding threaded aperture in said lower plate; and at least one screw for connecting said apertures.

8. The method of claim 1, wherein said dispensing unit further comprises a vent hole for allowing fluid communication between said dispensing unit and an ambient environment.

9. The method of claim 8, wherein said dispensing unit further comprises a vent hole plug for forming a fluid tight seal for said vent hole.

10. The method of claim 1, wherein said dispensing unit further comprises a separating member on at least one of the upper plate and the lower plate for defining a plurality of sections of said dispensing unit that are fluid tight with respect to one another.

11. The method of claim 1, wherein said dispensing unit further comprises distribution means interposed between said upper plate and said lower plate for evenly distributing said sample in said dispensing unit.

12. The method of claim 11, wherein said distribution means comprises a distribution plate having a plurality of uniformly or semi-uniformly spaced hollow channels.

13. The method of claim 12, wherein said distribution plate further comprises a ramped trough on a top corner of said distribution plate and at least one capillary channel on a bottom side of said distribution plate.

14. The method of claim 1, wherein said dispensing unit is sterile.

15. The method of claim 1, wherein each of said receptacles of said storage unit is sealed with a sealing cap.

16. The method of claim 1, wherein said receptacles of said storage unit are covered with a fluid tight film septum.

* * * * *